US005602368A

United States Patent [19]

Kaneso

[11] Patent Number: 5,602,368

[45] Date of Patent: Feb. 11, 1997

[54] MUFFLER FOR AN INTERNAL COMBUSTION ENGINE

[75] Inventor: Hiroto Kaneso, Hachiouji, Japan

[73] Assignee: Apex Co., Ltd., Japan

[21] Appl. No.: 338,902

[22] Filed: Nov. 14, 1994

[30] Foreign Application Priority Data

Dec. 24, 1993 [JP] Japan ..... 5-345891

[51] Int. Cl.[6] ..... F01N 1/00

[52] U.S. Cl. ..... 181/255; 181/250; 181/272; 181/273

[58] Field of Search ..... 181/248, 249, 181/250, 251, 255, 257, 268, 272, 273, 275, 276, 282

[56] References Cited

U.S. PATENT DOCUMENTS

| | | | |
|---|---|---|---|
| 3,672,464 | 6/1972 | Rowley et al. | 181/255 |
| 4,177,875 | 12/1979 | Kurobe et al. | 181/272 X |
| 4,361,206 | 11/1982 | Tsai | 181/255 |
| 4,368,799 | 1/1983 | Wagner | 181/255 |
| 4,501,341 | 2/1985 | Jones | 181/250 |

*Primary Examiner*—Khanh Dang

*Attorney, Agent, or Firm*—Graham & James LLP

[57] ABSTRACT

In the exhaust fluid path, there are provided a porous pipe that is in communication with a muffling chamber via a plurality of small through-holes formed across a wall thickness of the pipe, and an inner pipe of a given length is inserted in the porous pipe with a gap formed between the outer surface of the inner pipe and the inner surface of the porous pipe. The gap is narrowed or closed in its outlet portion and thus the exhaust sound waves flowing through the gap are compressed so that interference and scattering into the muffling chamber of the exhaust sound waves via the small through-holes are promoted, thereby enhancing muffling performance. A plurality of small through-holes may also be formed in the inner pipe. A relatively large opening may be formed in part of the porous pipe to open into the muffling chamber, or a relatively large space may be formed which divides the porous pipe into two pipe elements and opens into the muffling chamber. The porous pipe may be formed as a dual-pipe structure to provide a triple-pipe structure as a whole. Another alternative arrangement may be such that the muffling chamber is partitioned by a wall having a plurality of small through-holes so as to provide a sub-chamber and that the tubular exhaust path opens into the sub-chamber so as to enhance exhaust efficiency.

12 Claims, 5 Drawing Sheets

( PRIOR ART )

MUFFLER FOR AN INTERNAL COMBUSTION ENGINE

BACKGROUND OF THE INVENTION

The present invention relates to mufflers for use in various internal combustion engines including automobile engines, and more particularly to such an improved muffler which achieves highly enhanced sound deadening or muffling performance.

As examples of mufflers conventionally used in automobiles are known those as shown in FIGS. 13 and 14. The muffler 1 shown in FIG. 13 comprises four chambers 2, 3, 4 and 5 partitioned off from each other. Exhaust from an engine (not shown) first enters the chamber 4 by way of an entry pipe 6, then flows through a porous communication pipe 7 having a multiplicity of small through-holes into the chamber 2, from which the exhaust further flows through an exit pipe 8 to be discharged out of the muffler 1. The chamber 4 is in fluid communication with the chamber 5 via a pipe 9. The muffler 1 thus arranged can cause scattering or expansion, resonance, interference, resistance, etc. of the exhaust sound waves to effectively muffle the exhaust sounds in a predetermined frequency band.

The muffler 10 shown in FIG. 14 comprises a porous pipe 13 linearly connecting entry and exit pipes 11 and 12 for fluid communication therebetween, a filter 14 covering the outer periphery of the porous pipe 13, and sound absorbing material 15 filled between the filter 14 and the inner surface of the muffler chamber. In this example, sounds in a predetermined frequency band are muffled by virtue of the particular sound absorbing characteristic of the sound absorbing material 15.

The above-mentioned prior art muffler 1 of FIG. 13 is designed to reduce the sound pressure level by complication and prolongation of the exhaust flow path, thus achieving superior sound absorbing characteristics. However, this muffler 1 unavoidably suffers from increased loss and resistance of the exhaust pressure which would cause extremely adverse effects during high speed rotation under high load. The other prior art muffler 10 of FIG. 14 can exhaust linearly to thereby achieve a lower exhaust pressure loss, but it can only muffle sounds in a specific frequency band corresponding to the peculiar characteristic of the sound absorbing material and can never muffle sounds in low frequency ranges. In particular, no muffling can be achieved in a range of 70 to 90 Hz which is an excitation frequency of cavity resonance in vehicle chamber. In addition, the sound absorbing material easily absorbs moisture and hence tends to cause corrosion of the tubular exhaust paths and metallic components of the muffler body, resulting in reduced durability of the muffler.

SUMMARY OF THE INVENTION

It is therefore an object of the present invention to provide a muffler for an internal combustion engine which achieves superior muffling characteristics.

It is another object of the present invention to provide a muffler for an internal combustion engine which achieves highly enhanced durability.

It is still another object of the present invention to provide a muffler for an internal combustion engine which achieves compatible enhancements in both of exhaust-pressure-loss lowering characteristic and muffling characteristics.

In order to accomplish the above-mentioned objects, the present invention provides a muffler for an internal combustion engine which comprises a muffler body including an entry port for introducing exhaust fluid into the muffler body, at least one chamber provided in the muffler body, and an exit port for discharging the exhaust fluid out of the muffler body, a first pipe section provided within the muffler body to allow the exhaust fluid to pass through the first pipe section in a predetermined exhaust flow direction, the first pipe section having a plurality of small through-holes formed across a wall thickness thereof in such a manner that the first pipe section communicates with the chamber via the small through-holes, and a second pipe section including a pipe of a given length that is inserted in the first pipe section with a gap formed between an outer peripheral surface of the pipe and an inner peripheral surface of the first pipe section. One of preferred forms of the gap is that the gap may have upstream and downstream gap portions as defined by the predetermined exhaust flow direction, and the gap may be wider in the upstream gap portion than in the downstream gap portion.

According to another aspect of the present invention, a muffler is proposed in which the second pipe section also has a plurality of small through-holes formed across a wall thickness thereof.

According to still another aspect of the present invention, a muffler is proposed in which the first pipe section has a relatively large opening that is formed in a portion thereof and opens into the chamber.

According to still another aspect of the present invention, a muffler is proposed in which the first pipe section is divided into two pipe elements, and the porous pipe section has a relatively large space between the pipe elements which opens into the chamber.

According to still another aspect of the present invention, a muffler is proposed in which the first pipe section includes a first porous pipe element of a relatively small diameter and a second porous pipe element of a relatively small diameter, and in which at least a portion of the first porous pipe element is received in the second porous pipe element and the inner pipe section is inserted in the first porous pipe element. In this manner, a muffler of a so-call triple-pipe structure is proposed.

According to still another aspect of the present invention, a muffler is proposed in which the chamber comprises a relatively large main chamber and a relatively small sub-chamber partitioned off from each other by a partition wall having a plurality of small through-holes formed across a wall thickness thereof, and in which the first pipe section is provided in correspondence to the main chamber. Furthermore, a muffler is proposed in which a tubular path communicating with the first pipe section opens into the sub-chamber and the upstream end of an exit pipe communicating with the exit port opens into the sub-chamber.

Because of the above-mentioned arrangement that a multiplicity of small through-holes of the first pipe section (which will be referred to as a porous pipe section hereinafter) are in communication with the interior space in the chamber closely covering the side surface of the porous pipe section, the exhaust sound waves of the exhaust fluid passing through the porous pipe section scatter into the chamber space via the through-holes, and thus various actions such as scattering and interference of the exhaust sound waves occur. Such actions greatly contribute to muffling of sounds in a predetermined frequency band (intermediate and high frequency ranges, for example). The particular characterizing feature of the present invention is that the muffler is comprised of a dual-pipe structure in which the second pipe section (which will be referred to as an inner pipe section hereinafter) is provided within the porous pipe section. Namely, the inner pipe section includes a pipe of a given length that is inserted in the porous pipe section, leaving a gap formed between the outer peripheral surface of the pipe and the inner peripheral surface of the porous pipe section. The exhaust sound waves are compressed by the gap, which promotes the scattering and interference etc. of the exhaust sound waves via the through-holes of the porous pipe section. Thus, the muffling effect can be further promoted.

Preferred form of the above-mentioned gap may be provided in a variety of ways. For instance, a predetermined downstream portion of the inner pipe section may lie in close proximity to the porous pipe section so that the gap is smallest in one portion thereof corresponding to the predetermined downstream portion of the inner pipe section. Alternatively, a predetermined downstream portion of the inner pipe section may lie in close contact with the porous pipe section, so as to close the gap. It is only sufficient that the gap is narrowed or closed in its downstream portion, or that the gap is wider in the upstream gap portion than in the downstream gap portion. Alternatively, a relative relationship between the outer diameter of the inner pipe section and the inner diameter of the porous pipe section may be set to vary in such a manner that the gap becomes gradually narrower from the upstream gap portion to the downstream gap portion. The gap may become narrower in a stepwise fashion. Or, the relative relationship between the outer diameter of the inner pipe section and the inner diameter of the porous pipe section may be set in such a manner that the gap has a substantially uniform cross-sectional area over a predetermined range from the upstream gap portion and is narrowed at a downstream end thereof. Alternatively, at least one of the outer diameter of the inner pipe section and the inner diameter of the porous pipe section may vary in such a manner that the gap varies in cross-sectional area. Other variations than the above-mentioned are also possible.

To generally consider a preferred form of the gap formed between the porous pipe section and the inner pipe section, the characterizing feature of the present invention is that the cross-sectional area or partial volume of a space between the upstream end closer to the entry port and the inner wall surface of the porous pipe section (for convenience, this space will provisionally be called a space inlet) is greater than that of a space between the downstream end closer to the exit port and the inner wall surface of the porous pipe section (this space will provisionally be called a space outlet). Namely, the space inlet is wider than the space outlet; that is, the space outlet is relatively narrowed or closed, and consequently, the exhaust sound waves flowing through the space formed in the dual-pipe structure comprising the porous and inner pipe sections are compressed by such a narrowed space outlet. This further promotes the scattering, interference etc. of the exhaust sound waves via the small through-holes of the porous pipe section. Therefore, such a preferred form of the space can further promote the muffling effect of the muffler.

The detailed embodiment of the inner and porous pipe sections constituting the dual-pipe structure may be designed in a variety of ways, such as a tapered pipe structure where the diameter of at least one of the pipe sections varies over a predetermined range from the upstream to downstream portions. The pipe diameter may vary in a stepwise fashion over a predetermined range from the upstream to downstream portions. Another alternative arrangement may be such that the two pipe sections each have an uniform diameter throughout the substantially entire length thereof and lie in close proximity or contact with each other so as to narrow or close the gap at the downstream end. The preferred variation in the gap may be realized by changing the diameter of both or either the two pipe sections. The pipe sections may be of any desired cross-sectional shape such as an oblong or polygon as well as a circle. Therefore, the term, pipe diameter, as used herein should be understood as having a same meaning as the cross-sectional area of the pipe.

It is only sufficient that the muffler according to the present invention is provided with the above-noted dual-pipe structure in a portion of the muffler. Any other structure may be added to the muffler as desired.

One preferred form of the present invention may comprise a combination of the exhaust flow path along which the exhaust entry and exit ports are disposed in substantially linear alignment, and of the dual-pipe structure. Such a combination provides an arrangement for drastically lowering resistance to and loss of the exhaust pressure (i.e., a lower exhaust-pressure-loss type muffler is provided) and thus can greatly contribute to enhancement in fuel efficiency and power performance. In such a case, necessary muffling performance can be achieved by the above-mentioned enhanced muffling performance based on the dual-pipe scheme, even when there is provided no sound absorbing material as required in the conventional straight-pipe structure mufflers. As the result, by not employing a great amount of sound absorbing material, it is allowed to effectively prevent corrosion of various metallic components, and hence poor durability resulting from such corrosion can be avoided.

Of course, in order to further enhance the muffling performance, the above-mentioned dual-pipe scheme and sound absorbing material may be used in combination. As an example, the sound absorbing material may be filled in a sound absorbing chamber so that the particular sound absorbing characteristic of the material can achieve complete muffling in predetermined frequency ranges to provide an even further muffling effect. In addition, provision of muffling material along at least a part of the inner wall surface of the sound absorbing chamber is very advantageous in that it can reduce the total amount of muffling material required, and also in that, where the muffling material is used in combination with the dual-pipe scheme, it can effectively eliminate the vibrating waves of the exhaust sounds which will never be eliminated by the dual-pipe scheme alone.

The number of chambers provided in the muffler body may be other than one, such as two or more. For example, in addition to a chamber communicating with the small through-holes of the porous pipe section (for convenience, this chamber will be called a first chamber), a second chamber may be provided in communication with the first chamber via a communication pipe. Such communication from the first chamber to the second chamber via the communication pipe forms a "Helmholtz resonator" and contributes muffling in a predetermined low frequency band. The number of the communication pipe provided in the above-mentioned manner may be other than one as desired, so that "Helmholtz resonators" are formed in correspondence to the respective communication pipes in order to contribute to muffling in low frequency band. By properly setting the respective resonators, they can achieve effective muffling not only in a frequency range of 70 to 90 Hz which is an excitation frequency range for cavity resonance in a vehicle chamber but also in a little higher low frequency range (for example, 200 to 300 Hz). Accordingly, in combination with the muffling action in intermediate and high frequency ranges by means of the small through-holes of the porous pipe section, such a simple dual-pipe structure can achieve effective muffling over wide band from low frequency range to intermediate and high frequency ranges. Even in such a case, the principal exhaust flow path can maintain a straight exhaust structure of the lower exhaust-pressure-loss type.

Furthermore, the muffler of the present invention may comprise a second chamber provided separately from the first chamber communicating with the small through-holes of the porous pipe section, a second porous pipe element which is provided in the front or rear of the first porous pipe element between the entry and exit ports and which has a plurality of small through-holes formed across its wall thickness, and a second chamber which closely covers the outer periphery of the second porous pipe element, contains a space communicating with the small through-holes of the second porous pipe element and accommodates sound absorbing material in that space. The muffler thus arranged can also achieve effective muffling in predetermined band by virtue of the particular sound absorbing characteristic of the sound absorbing material.

Provision of a plurality of small through-holes in the inner pipe sections as well is very advantageous in that scattering and interference of the exhaust sound waves are caused via the small through-holes in the inner pipe section and act to enhance the muffling effect.

Moreover, provision of a relatively large opening in a part of the porous pipe to open into the chamber is extremely useful in contribution to stabilized muffling performance, because instantaneously raised exhaust pressure is allowed to escape through the opening so that pressure distribution can be immediately stabilized. The same effect may be achieved by dividing the porous pipe sections into two pipe elements and by forming between the two pipe elements the above-mentioned relatively large opening into the chamber. Furthermore, a triple-pipe structure comprising the first and second porous pipes and inner pipe section stabilizes the muffling performance in a similar manner to the dual-pipe scheme and achieves further enhanced muffling performance.

Another muffler proposed by the present invention is arranged in such a manner that a main chamber and a sub-chamber are provided which are partitioned off from each other by a partition wall having a plurality of small through-holes formed across a wall thickness thereof, the porous pipe section corresponds to the main chamber, one end of the porous pipe section opens into the sub-chamber, and the upstream end of the exit pipe connecting to the exit port opens into the sub-chamber. The main chamber and sub-chambers are brought into pressure communication with each other via the partition wall having the plurality of small through-holes and thus increase the speed of the exhaust fluid to be absorbed into the exit pipe, with the result that it is permitted to greatly enhance not only the muffling effect but also the exhaust efficiency.

To implement the present invention, various forms of embodiments mentioned above and below may be partly combined in a variety of ways.

Now, the preferred embodiments of the present invention will be described in detail below with reference to the accompanying drawings.

DETAILED DESCRIPTION OF THE PREFERRED EMBODIMENTS

Figure 1:
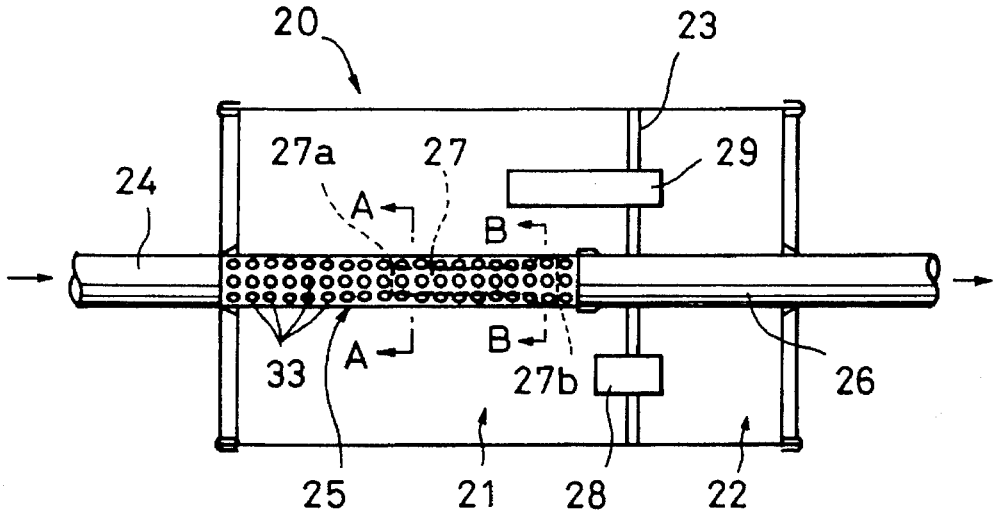
FIG. 1 is a schematic sectional view of a muffler in accordance with an embodiment of the present invention.
Figure 2A:
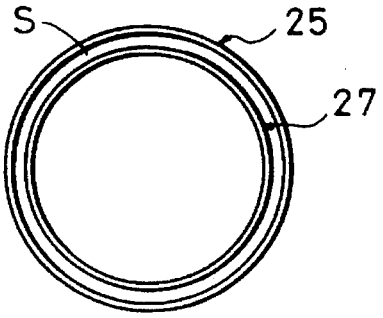
FIG. 2A is a cross-sectional view taken along line A—A of FIG. 1.
Figure 2B:
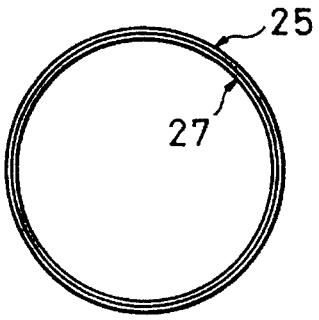
FIG. 2B is a cross-sectional view taken along line B—B of FIG. 1.

Now, a detailed description will be given on the preferred embodiments of the invention with reference to FIGS. 1 to 12, in which same reference characters denote like parts.

In FIG. 1, a muffler 20 in accordance with an embodiment of the present invention comprises two chambers, first and second chambers 21 and 22 that are partitioned off from each other by a wall 23. Exhaust from an engine (not shown) is introduced through an entry pipe 24 (corresponding to a muffler entry port) into the muffler body and is then discharged through an exit pipe 26 (corresponding to a muffler exit port) out of the muffler body. A porous pipe 25 having a multiplicity of small through-holes 33 in its side, i.e., across its wall thickness is connected at one end to the entry pipe 24 in linear alignment. The porous pipe 25 is also connected at the other end to the exit pipe 26 in linear alignment. Thus, the exhaust fluid is caused to pass through the muffler 20 in a straight line, so that the muffler 20 provides a very efficient, exhaust-pressure-loss lowering arrangement.

The porous pipe 25 is provided in correspondence to the first chamber 21 in fluid communication with the entry and exit pipes 24 and 26 as noted, as well as the first chamber 21 by way of the multiple small through-holes 33. This will cause scattering (expansion), interference, etc. of vibrating exhaust sound waves via the through-holes 33, thereby achieving effective muffling of sounds in predetermined high and intermediate frequency ranges (e.g., sounds of air current) by virtue of a porous-resonance type muffling action.

An inner pipe 27 having a predetermined length is fixedly mounted within the porous pipe 25 so as to provide a dual-pipe structure. This inner pipe 27 is characterized in that one of its opposite ends closer to the muffler exit port (hereinafter referred to as a "downstream end portion 27*b*" as defined by the general direction in which the exhaust flows through the muffler body) is greater in diameter than the other of the ends closer to the muffler entry port (hereinafter referred to as an "upstream end portion 27*a*"). Such sizing of the inner pipe 27 may be clear from FIG. 2A which is an enlarged cross-sectional view taken along line A—A of FIG. 1 and FIG. 2B which is an enlarged cross-sectional view taken along line B—B of FIG. 1. Therefore, because of the sizing of the inner pipe 27, a space or gap S between the porous pipe 25 and the inner pipe 27 is larger in the upstream end portion as seen from FIG. 2A and is smaller (or closed) in the downstream end portion as seen from FIG. 2B.

The detailed structure of the inner pipe 27 may be designed in a variety of ways. For example, while the downstream end portion 27*b* is formed to have a greater diameter as illustrated, the remaining portion of the inner pipe 27 may be formed to have a substantially uniform diameter that is smaller than that of the downstream end portion 27*b*. Alternatively, the inner pipe 27 may be a tapered pipe structure where the diameter becomes gradually greater from the upstream end portion 27*a* to the downstream end portion 27*b*. Still alternatively, the inner pipe 27 may be designed in such a manner that the diameter becomes greater in a stepwise fashion from the upstream end portion 27*a* to the downstream end portion 27*b*. Further, the entire periphery of the downstream end portion 27*b* closer to the muffler exit port may be in close contact with the inner wall surface of the porous pipe 25 so as to completely close the gap outlet of the dual-pipe structure, or may be appropriately spaced apart from the inner wall surface of the porous pipe 25 so as not to completely close the gap outlet. In any case, it is only necessary that the inner pipe 27 is designed to provide a narrowed gap outlet of the dual-pipe structure.

Due to such a dual-pipe structure, the cross-sectional area of the gap S formed between the porous pipe 25 and the inner pipe 27 is greater in the upstream region between the upstream end portion 27*a* and the inner wall surface of the porous pipe 25 (for convenience of explanation, this is called a gap inlet) than in the downstream region between the downstream end portion 27*b* and the inner wall surface of the porous pipe 25 (this gap is called a gap outlet). Because the gap inlet is greater in cross-sectional area than the gap outlet, the exhaust fluid flowing through the gap S between the porous pipe 25 and the inner pipe 27 is compressed by the narrowed gap outlet, so that scattering, interference, etc. of the vibrating waves of the exhaust fluid via the small through-holes of the pipe 25 are promoted to a even greater degree. Accordingly, it is possible to further enhance the muffling effect for predetermined high and intermediate frequency ranges.

Additionally, in the embodiment of FIG. 1, a communication pipe 28 is provided which allows the exhaust to flow from the first chamber 21 to the second chamber 22. This communication pipe 28 provides a "Helmholtz resonator" (a first resonator) to contribute to muffling of sounds in a predetermined low frequency band. In another part of the muffler 20, another communication pipe 29 is provided which allows the exhaust to flow from the first chamber 21 to the second chamber 22. This communication pipe 29 also provides a "Helmholtz resonator" (a second resonator) to contribute to muffling of sounds in another predetermined low frequency band. Thus, the two resonators can contribute to muffling of sounds in two different low frequency bands.

By, for example, properly setting the length and/or diameter of the inner pipe 27, the length of the porous pipe 25, the size, number etc. of the through-holes of the pipe 25, and the number, length and diameter of the communication pipes 28 and 29 constituting the resonators, it is allowed to muffle not only so-called "confined sounds" in a frequency range of 70 to 90 Hz that is an excitation frequency of cavity resonance in a vehicle chamber but also such sounds in another predetermined low frequency range a little higher than the first-mentioned range (e.g., 200 to 300 Hz). Therefore, in combination with the muffling in high and intermediate frequency bands by means of the small through-holes of the porous pipe 25, the simple dual-chamber muffler structure of the embodiment can effectively achieve muffling of sounds over a wide range from the low frequency band to the high and intermediate frequency bands.

Figure 3:
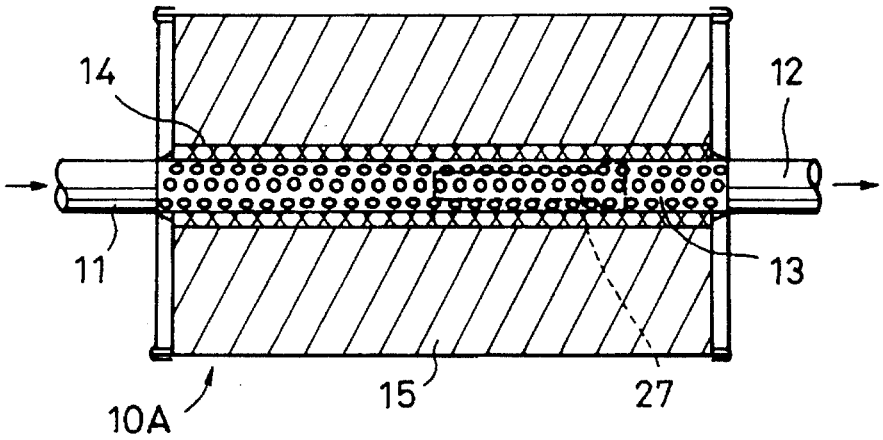
FIG. 3 is a schematic sectional view of a muffler in accordance with another embodiment of the present invention.
Figure 14:
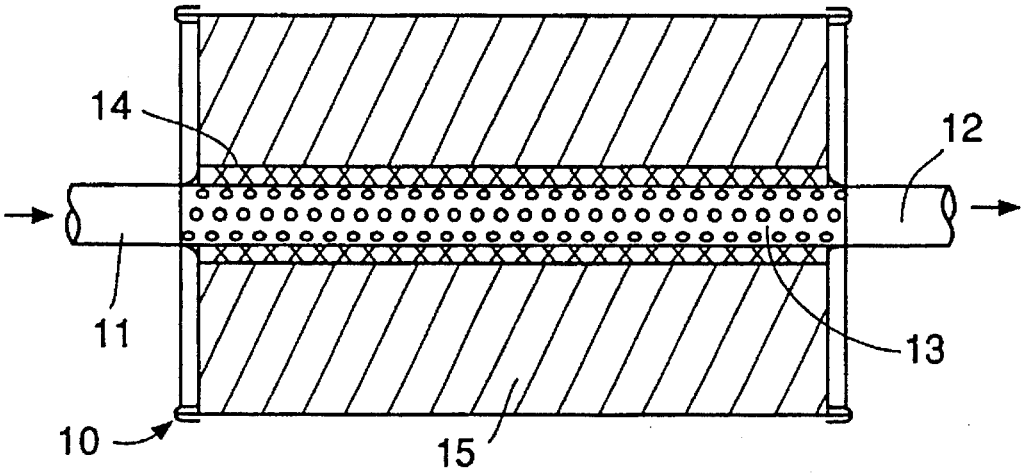
FIG. 14 is a schematic sectional view of another example of a prior art muffler.

FIG. 3 shows another example of the present invention. A muffler 10A according to this embodiment, similarly to the prior art muffler 10 of FIG. 14, comprises a porous pipe 13 linearly connecting an entry pipe 11 (corresponding to a muffler entry port) and an exit pipe 12 (corresponding to a muffler exit port), a filter 14 covering the outer periphery of the porous pipe 13, and sound absorbing material 15 made of, for example, glass wool filled between the filter 14 and the inner wall surface of the muffle chamber. Within the porous pipe 13, there is mounted an inner pipe 27 that is constructed in a similar manner to the inner pipe 27 of FIG. 1. This embodiment thus arranged provides muffling in a predetermined frequency band by virtue of the sound absorbing characteristic of the sound absorbing material 15, in addition to the muffling action of the porous pipe 13 promoted by the inner pipe 27.

Figure 4:
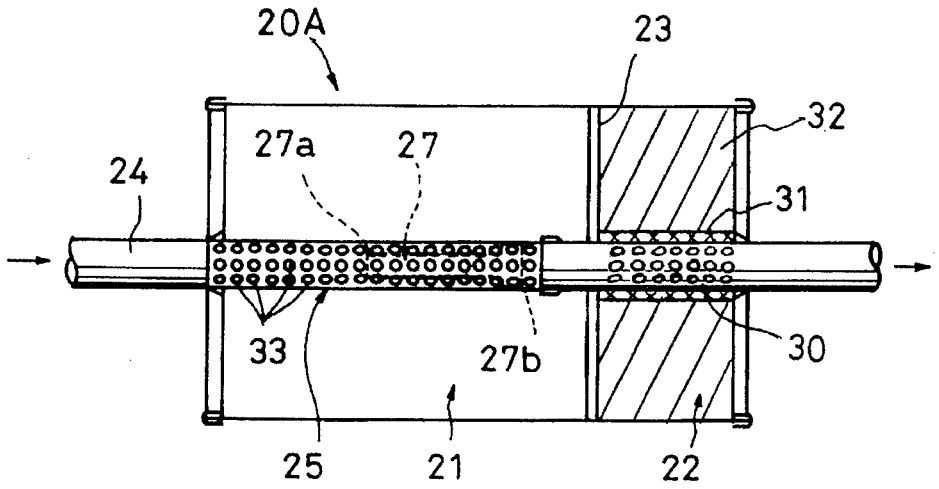
FIG. 4 is a schematic sectional view of a muffler in accordance with still another embodiment of the present invention.

FIG. 4 shows still another embodiment of the present invention, which is a dual-chamber structure comprising first and second chambers 21 and 22 in a similar manner to the muffler 20 of FIG. 1. An inner pipe 27 of the same construction as in FIG. 1 is provided within a porous pipe 25 corresponding to the first chamber 21. A pipe 30 corresponding to the second chamber 22 is a porous pipe having a multiplicity of small through-holes formed across its wall thickness. In the second chamber 22, a filter 31 covers the outer periphery of the porous pipe 30, and sound absorbing material made of, for example, glass wool is filled between the filter 31 and the inner surface of the chamber 22, as in the embodiment of FIG. 3. In this embodiment, no communication pipe is provided which connects the first and second chambers 21 and 22 in fluid communication. However, this embodiment also provides muffling action in the second chamber 22 by virtue of the sound absorbing characteristic of sound absorbing material 32, in addition to the muffling action in the first chamber 21 via a porous pipe 25 promoted by the inner pipe 27. In an alternative arrangement, the first and second chambers 21 and 22 may be provided separately from each other. Further, the second chamber 22 provided with the sound absorbing material 32 may be disposed in front of the first chamber 21.

Figure 5:
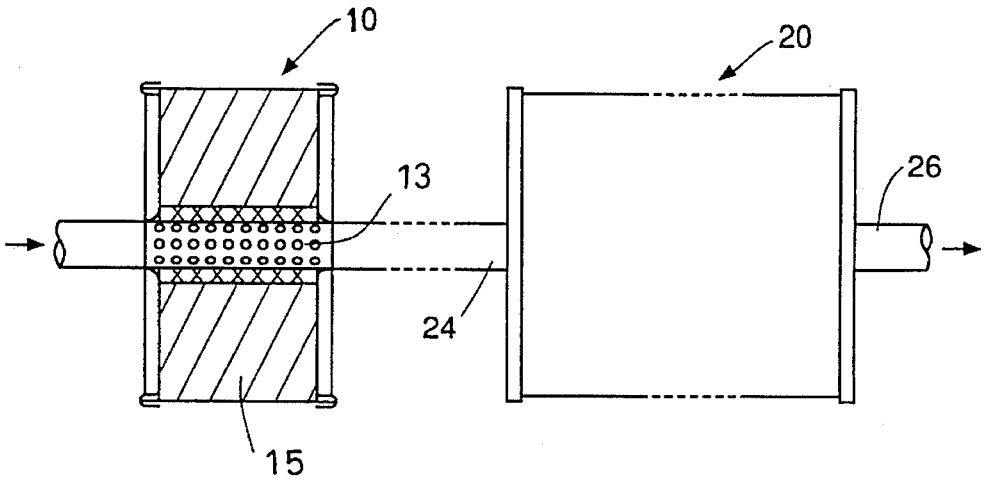
FIG. 5 is a schematic sectional view of a muffler in accordance with still another embodiment of the present invention.

FIG. 5 shows still another embodiment of the present invention, in which a first muffler section 20 may be constructed in the same manner as the muffler 20 of FIG. 1. In front of the first muffler section 20 is provided a second muffler section 10 which may be constructed in the same manner as the prior art muffler 10 of FIG. 14. Thus, this embodiment also provides muffling action in the second muffler section 10 by virtue of the sound absorbing characteristic of sound absorbing material 15, in addition to the muffling function in the first muffler section 20 via a porous pipe 25 promoted by an inner pipe 27. In addition, this embodiment can completely remove noises in certain band which may not be removed in the embodiment of FIG. 1.

Figure 6:
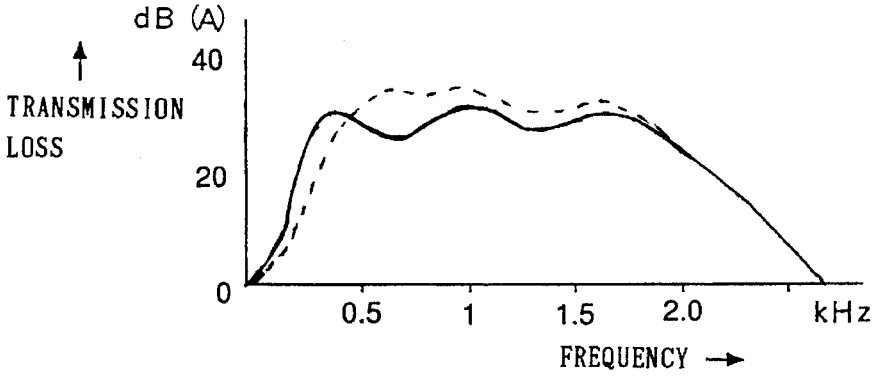
FIG. 6 is a diagram showing an example of muffling characteristics of the embodiment of FIG. 5.

FIG. 6 shows an example of a muffling characteristic obtained in the FIG. 5 embodiment, in which solid line represents an example of a muffling characteristic achieved by the first muffler section 20 and broken line represents an example of a muffling characteristic achieved by the second muffler section 10.

In the above-described embodiment, in order to allow the gap S between the outer peripheral surface of the inner pipe 27 and the inner peripheral surface of the surrounding porous pipe 25 or 13 to be narrowed in the downstream end portion, the inner pipe has varying diameters while the inner diameter of the porous pipe 25 or 13 is uniform throughout its entire length. Conversely, to achieve the same configuration, the outer diameter of the inner pipe 27 may be uniform throughout its entire length while the surrounding porous pipe 25 or 13 may have varying inner diameters. Alternatively, both of the outer diameter and inner diameter of the inner and porous pipes 25 or 13 may be varied. In any case, it is only necessary that the gap S between the porous pipe 25 or 13 and inner pipe 25 be narrowed gradually or stepwise toward the gap outlet, or be narrowed or closed at at least its downstream end portion adjacent to the exhaust exit port.

Further, the muffling chamber structure of the invention should not be understood as restricted to a single-chamber structure or dual-chamber structure as shown in FIGS. 1, 3 and 4, but may be modified in a variety of ways.

Figure 7:
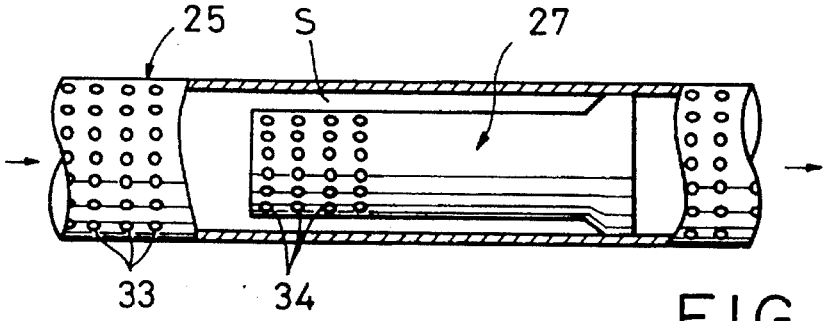
FIG. 7 is an enlarged side view showing a modified example of an inner pipe section in the muffler of the present invention.

Furthermore, as shown in FIG. 7, the inner pipe 27 may also have a plurality of small through-holes 34. This will cause the vibrating exhaust sound waves to be scattered via the small through-holes 34 so that scattering, interference, etc. of the exhaust sound waves are also promoted between the inner pipe 27 and the surrounding porous pipe 25, to greatly contribute to effective muffling of the vibrating exhaust sound waves up to wider low frequency ranges.

Figure 8:
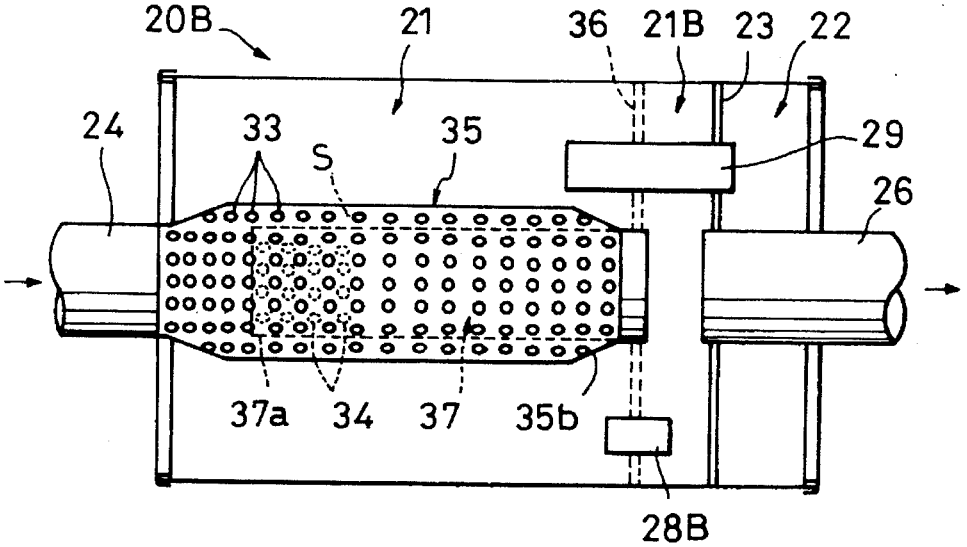
FIG. 8 is a schematic sectional view of a muffler in accordance with still another embodiment of the present invention.

A muffler in accordance with still another embodiment of the present invention is shown in FIG. 8, which is characterized in that an inner pipe 37 has an uniform diameter throughout its length while a porous pipe 35 surrounding the inner pipe 37 has varying diameters. The porous pipe 35 having a multiplicity of small through-holes 33 formed across its wall thickness is connected at one end to an exhaust entry pipe 24 and accommodates therein an inner pipe 37 having the uniform diameter. The surrounding porous pipe 35 includes a swollen intermediate portion, whose upstream end portion corresponds in position to an upstream end portion 37*a* of the inner pipe 37 closer to the entry port and has a relatively large diameter, so as to provide a relatively large gap S between the porous pipe 35 and the inner pipe 37. In a downstream end portion 35*b* closer to the exhaust exit port, the diameter of the porous pipe 35 is gradually reduced to ultimately contact the inner pipe 37 so as close the gap S. Thus, in a similar manner to the above-mentioned, the gap S is formed to be wider in its inlet portion than its outlet portion and exhaust sound waves entering the gap S between the porous pipe 35 and the inner pipe 37 are compressed by the narrowed outlet portion, so that scattering, interference, etc. of the exhaust sound waves via the small through-holes 33 of the porous pipe 35 are effectively promoted and muffling effect for a predetermined frequency band can be further promoted.

In addition, in the embodiment of FIG. 8, a plurality of small through-holes 34 are formed in the inner pipe 37 as well. In the same manner as previously mentioned, this achieves an muffling effect over a still wider frequency band. Of course, the small through-holes 34 may be omitted in the inner pipe 37 as needed.

Further, in the embodiment of FIG. 8, a first chamber 21 is partitioned by a wall 36 to provide a sub-chamber (or third chamber) 21B, and the wall 36 has a multiplicity of small through-holes formed across its wall thickness. A communication pipe 28B is also provided for fluid communication between the first chamber 21 and the sub-chamber 21B. With such arrangements, a muffling effect can be achieved also by interference and/or scattering of the exhaust sound waves from the first chamber (i.e., main chamber) 21 to the sub-chamber 21B via the small through-holes of the wall 36 and communication pipe 28B.

Moreover, in the embodiment of FIG. 8, the porous pipe (i.e., outer pipe) 35 and inner pipe 37 both have downstream ends opening into the sub-chamber 21B and are in fluid communication with an exit pipe 26 by way of the sub-chamber 21B. A muffling effect can be achieved also by interference and/or scattering of the exhaust sound waves from the sub-chamber 21B to the first chamber 21 via the downstream opened ends of the pipes 35 and 37. Although, in this embodiment, a part of a tubular path extending from the exhaust entry pipe 24 to the exhaust exit pipe 26 is replaced with the sub-chamber 21B, a exhaust-pressure-loss lowering characteristic can be achieved as in the other embodiments because a straight exhaust flow path can be maintained.

In addition, because the main chamber 21 and the sub-chamber 21B are in pressure communication with each other via a partition wall 36 having a plurality of small through-holes and this increases the speed of the exhaust fluid to be absorbed into the exit pipe 26, it is permitted to greatly enhance not only the muffling effect but also the exhaust efficiency of the muffler.

Figure 9:
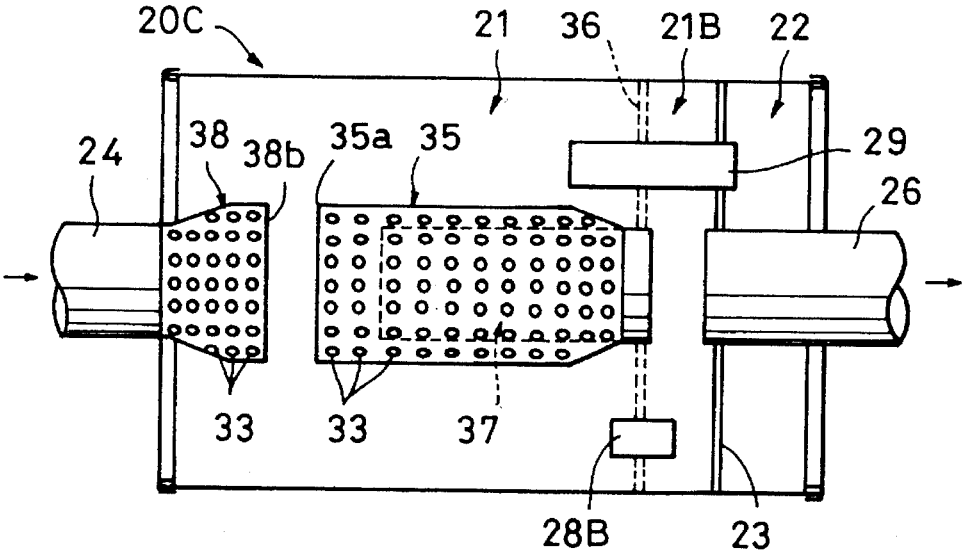
FIG. 9 is a schematic sectional view of a muffler in accordance with still another embodiment of the present invention.

FIG. 9 shows a muffler 20C in accordance with still another embodiment of the present invention. This muffler 20C is a modified example of the FIG. 8 embodiment, where an inner pipe 37 has an uniform diameter throughout its entire length while an outer porous pipe 35 surrounding the inner pipe 37 has varying diameters as in the embodiment of FIG. 8. In this embodiment, the outer porous pipe 35 is not directly connected to an entry pipe 24 but is open at its upstream end portion 35*a*. Instead, a short porous pipe 38 is connected to the entry pipe 24 and has a downstream end portion 38*b* that is almost coaxially opposed to the upstream end portion 35*a* of the porous pipe 35 with a relatively short interval or opening left therebetween. Although in this embodiment, part of the outer porous pipes 35 and 38 are removed in such a manner that their opposed ends both opens into the first chamber 21, an exhaust-pressure-loss lowering characteristic can be achieved as in the other embodiments because a straight exhaust flow path can be maintained. In addition, when the exhaust pressure is instantaneously increased, the exhaust pressure is allowed to immediately escape through the open ends of the porous pipes 38 and 35 into the first chamber 21, thereby stabilizing the pressure distribution and greatly contributing to stabilization of the muffling performance. It should be apparent that such a modification where the upstream end portion of the outer porous pipe is partly removed to allow its end to open into the muffling chamber is also applicable to such a muffler which is provided with a porous pipe of uniform diameter as shown in FIG. 1.

Figure 10:
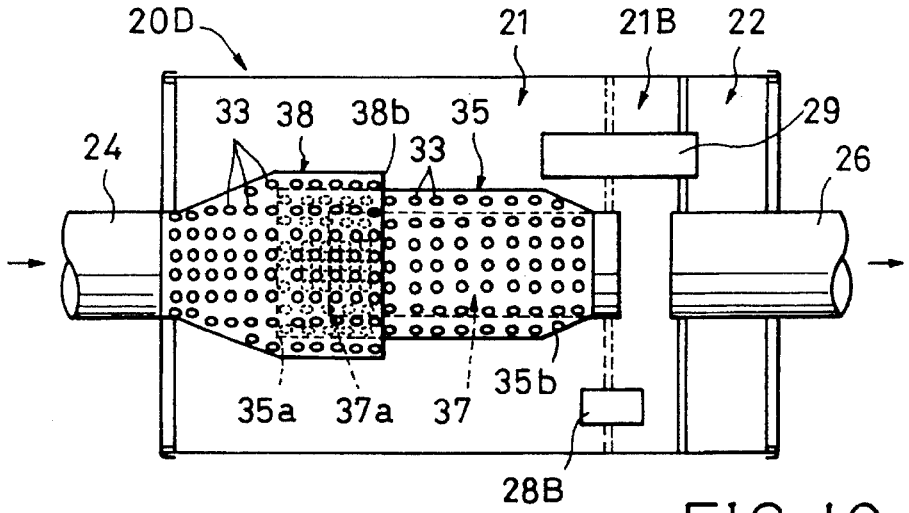
FIG. 10 is a schematic sectional view of a muffler in accordance with still another embodiment of the present invention.

FIG. 10 shows a muffler 20D in accordance with still another embodiment of the present invention, which is a modification of FIG. 9 embodiment. In this modified muffler 20D, a porous pipe 38 connected to an exhaust entry pipe 24 is greater in diameter than a porous pipe 35, and an upstream end portion 35*a* of the porous pipe 35 is inserted in a downstream end portion 38*b* of the porous pipe 38 so as to provide a triple-pipe structure as a whole. Also in this embodiment, an exhaust-pressure-loss lowering characteristic can be achieved as in the other embodiments because a straight exhaust flow path can be maintained. In addition, when the exhaust pressure is instantaneously increased, the exhaust pressure is allowed to immediately escape through the open ends of the porous pipes 38 and 35 into a first chamber 21, thereby stabilizing the pressure distribution and greatly contributing to stabilization of the muffling performance. It should be apparent that such a triple-pipe structure is also applicable to a muffler that is provided with a porous pipe of uniform diameter as shown in FIG. 1.

In the embodiments having two separate porous pipes 35 and 38 as shown in FIGS. 9 and 10, the porous pipe 38 closer to the muffler entry port may have a longer length, and an inner pipe may be mounted within the porous pipe 38, and an inner pipe 37 within the porous pipe 35 may omitted as desired. Further, the muffling promotion effect can be achieved by the present invention in two separate places, if an inner pipe is provided within each of the porous pipe 38 and 35 and the gap between the inner pipe and the porous pipe 38 or 35 is narrowed at the downstream end portion.

Figure 11:
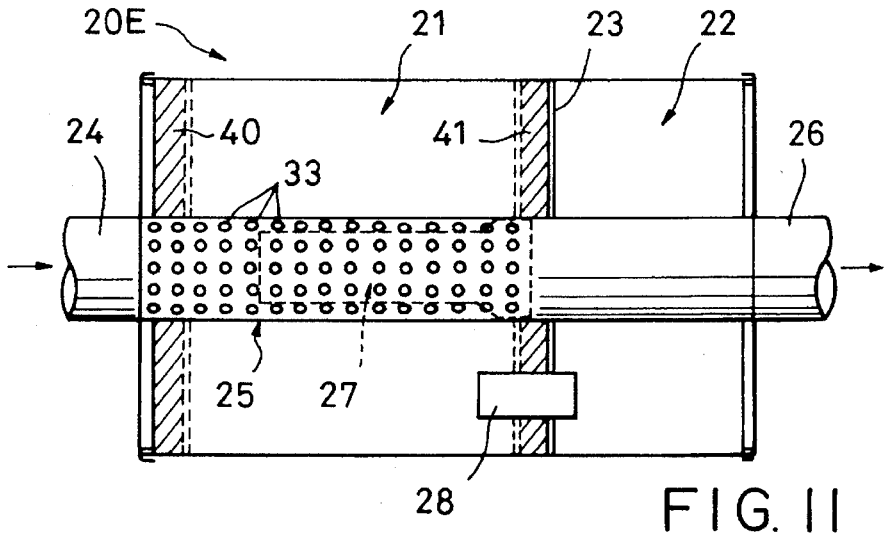
FIG. 11 is a schematic sectional view of a muffler in accordance with still another embodiment of the present invention.

A muffler 20E in accordance with still another embodiment of the present invention as shown in FIG. 11 is a modification of the embodiment of FIG. 1, and this modified muffler 20E is characterized in that sound absorbing materials 40 and 41 are provided on and along the wall surface of a first chamber 21. The use of the sound absorbing materials 40 and 41 act to muffle sounds in a predetermined frequency band (e.g., high frequency band). Thus, together with a sound muffling effect for other predetermined bands (e.g., intermediate and high frequency bands) achieved by the dual-pipe structure comprised of a porous pipe 25 and an inner pipe 27, the muffler 20E can also achieve effective muffling over wider frequency bands as a whole.

Figure 12:
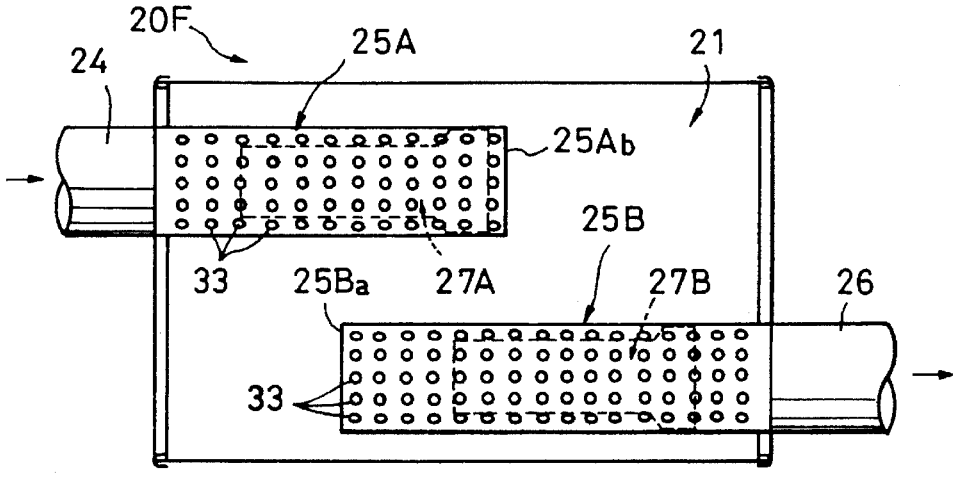
FIG. 12 is a schematic sectional view of a muffler in accordance with still another embodiment of the present invention.
Figure 13:
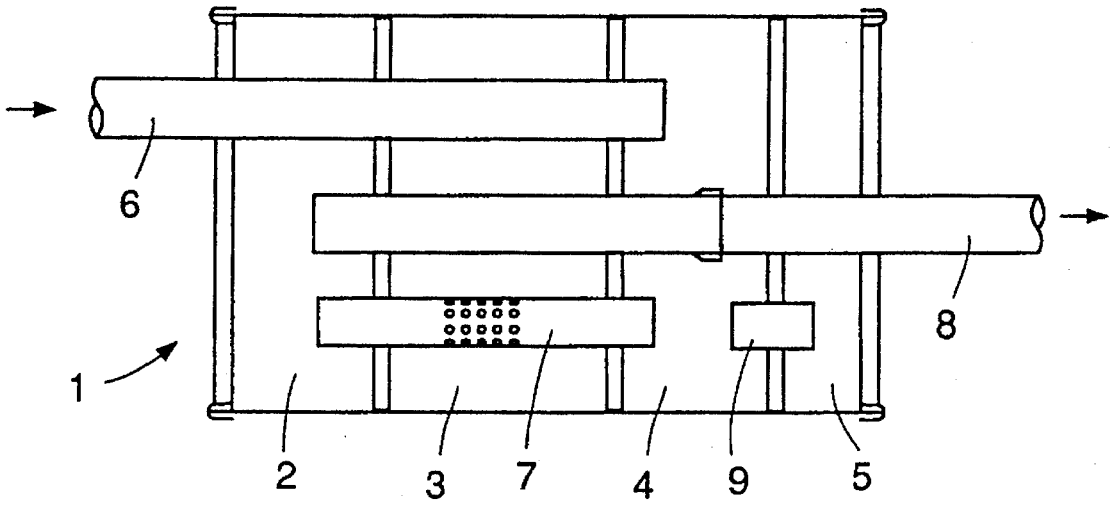
FIG. 13 ( PRIOR ART )
FIG. 13 is a schematic sectional view of an example of a prior art muffler.

FIG. 12 shows a muffler 20F in accordance with still another embodiment of the present invention, in which an exhaust entry pipe or port 24 and an exhaust exit pipe or port 26 are not provided in linear alignment with each other. But, the dual-pipe scheme of the present invention can also be applied to such a non-linear arrangement. Namely, a first porous pipe 25 connected at its upstream end to an entry pipe 24 has a downstream end 25A*b* opening into a chamber 21 and also has a multiplicity of small through-holes 33 across its wall thickness. A first inner pipe 27A is mounted within the first porous pipe 25A. Similarly, a second porous pipe 25B has an upstream end 25B*a* opening into the chamber 21 and is connected at its downstream end to the exit pipe 26. The second porous pipe 25B has a multiplicity of small through-holes 33 formed across its wall thickness, and a second inner pipe 27B is mounted within the porous pipe 25B. Similarly to the inner pipe 27 shown in FIG. 1, each of the inner pipes 27A and 27B has a greater diameter in its downstream end portion closer to the exhaust exit port than in its upper end portion closer to the exhaust entry port, so that the gap between the inner pipe 27A or 27B and the corresponding porous pipe 25A or 25B is narrowed in its downstream end portion or gap outlet. Such an arrangement will permit the muffling promotion effect of the present invention in two separate places within the muffler 20F. It should be apparent that in this embodiment as well, the relative diameter relationship between the inner pipes and porous pipes may be reversed in such a manner that the inner pipes have an uniform diameter throughout the entire length thereof while the porous pipes 25A and 25B have varying diameters.

Further, various other modifications may be made by combining the partial structures of the above-described embodiments. For example, a plurality of small through-holes may be formed in any of the inner pipes of FIGS. 9 to 12, as shown in FIG. 7. Furthermore, the number of the sound muffling chambers may be changed as needed in the above-described embodiments. Moreover, it should be appreciated that the most significant feature of the present invention, i.e., the dual-pipe structure (that is a structure comprised of an outer porous pipe and an inner pipe received in the porous pipe), may be partially applied to a part of exhaust flowing pipe in a known muffler arrangement. Such a partial implementation of the dual-pipe structure is of course within the scope of the present invention.

What is claimed is:

1. A muffler for an internal combustion engine comprising:

a muffler body including an entry port for introducing exhaust fluid into said muffler body, at least one chamber provided in said muffler body, and an exit port for discharging the exhaust fluid out of said muffler body, said entry and exit ports being disposed in linear alignment with each other;

a first pipe section extending continuously between said entry and exit ports within said muffler body so as to allow the exhaust fluid to pass through said first pipe section in a predetermined exhaust flow direction from said entry port to said exit port, said first pipe section including a porous portion having a plurality of small through-holes formed across a wall thickness thereof in such a manner that said porous portion of said first pipe section communicates with said chamber via said small through-holes; and a second pipe section including a pipe of a given length that is inserted in said porous portion of said first pipe section and forming a gap between an outer peripheral surface of said pipe and an inner peripheral surface of said porous portion of said first pipe section, said gap having upstream and downstream end portions as defined by said exhaust flow direction, said upstream end portion of said gap being in communication with an inner space of said porous portion of said first pipe section.

2. A muffler for an internal combustion engine as defined in claim 1 wherein said gap is wider in the upstream end portion than in the downstream end portion.

3. A muffler for an internal combustion engine as defined in claim 1 wherein said gap is narrowed in the downstream end portion.

4. A muffler for an internal combustion engine as defined in claim 1 wherein said gap is closed in the downstream end portion.

5. A muffler for an internal combustion engine as defined in claim 1 wherein a predetermined downstream portion of said second pipe section lines in close proximity to said porous portion of said first pipe section so that said gap is smallest in a portion thereof corresponding to the predetermined downstream portion of said second pipe section.

6. A muffler for an internal combustion engine as defined in claim 1 wherein a predetermined downstream portion of said second pipe section lies in close contact with said porous portion of said first pipe section.

7. A muffler for an internal combustion engine as defined in claim 1 wherein a relative relationship between an outer diameter of said second pipe section and an inner diameter of said porous portion of said first pipe section is set in such a manner that said gap becomes gradually narrower over a predetermined range between the upstream and downstream end portions.

8. A muffler for an internal combustion engine as defined in claim 1 wherein a relative relationship between an outer diameter of said second pipe section and an inner diameter of said porous portion of said first pipe section is set in such a manner that said gap becomes narrower in a stepwise fashion over a predetermined range between the upstream and downstream end portions.

9. A muffler for an internal combustion engine as defined in claim 1 wherein a relative relationship between an outer diameter of said second pipe section and an inner diameter of said porous portion of said first pipe section is set in such a manner that said gap has a substantially uniform cross-sectional area over a predetermined range from the upstream end portion and is narrowed at said downstream end portion.

10. A muffler for an internal combustion engine as defined in claim 1 wherein at least one of the outer diameter of said second pipe section and the inner diameter of said porous portion of said first pipe section varies so that said gap varies in cross-sectional area.

11. A muffler for an internal combustion engine as defined in claim 1 wherein said muffler body contains at least two of said chambers partitioned from each other by a partition wall, and said porous portion of said first pipe section is provided in correspondence to at least one of said chambers, and wherein a communication pipe is further provided to extend through said wall for communication between said two chambers.

12. A muffler for an internal combustion engine comprising:

a muffler body including an entry port for introducing exhaust fluid into said muffler body, at least one chamber provided in said muffler body, and an exit port for discharging the exhaust fluid out of said muffler body; and an exhaust flow path provided between and in substantially linear alignment with said entry and exit ports, said exhaust flow path comprising:

a first tubular path section including a porous pipe section that has a plurality of small through-holes formed across a wall thickness thereof and is in communication with said chamber via the small through-holes, and an inner pipe section inserted in said porous pipe section with a gap formed between an outer peripheral surface of said inner pipe section and an inner peripheral surface of said porous pipe section, said porous pipe section having an open end; and a second tubular path section having one end connected to said entry port and another end opening into said porous pipe section, wherein said other end of said second tubular path section is larger in diameter than the open end of said porous pipe section, and wherein the open end of said porous pipe section is received in said other end of said second tubular path section.

* * * * *